United States Patent [19]

Martin et al.

[11] Patent Number: 4,492,067

[45] Date of Patent: Jan. 8, 1985

[54] END STILE APPARATUS AND METHOD FOR AN OVERHEAD DOOR SECTION

[75] Inventors: David O. Martin, Salt Lake City; Lawrence G. Martin, Bountiful, both of Utah

[73] Assignee: Martin Door Manufacturing, Salt Lake City, Utah

[21] Appl. No.: 428,101

[22] Filed: Sep. 29, 1982

[51] Int. Cl.[3] ..... E04C 2/38

[52] U.S. Cl. ..... 52/822; 160/229 R; 29/155 R; 29/525

[58] Field of Search ..... 52/821, 588, 822, 823, 52/829; 160/229 R, 201; 29/155 R, 52 B

[56] References Cited

U.S. PATENT DOCUMENTS

| | | | |
|---|---|---|---|
| 2,643,714 | 6/1953 | Wolf | 160/201 X |
| 3,740,916 | 6/1973 | Kenaga | 52/588 |
| 4,075,810 | 2/1978 | Zakrzewski | 52/588 |
| 4,284,119 | 8/1981 | Martin | 52/588 |

*Primary Examiner*—John E. Murtagh
*Assistant Examiner*—Kathryn Ford
*Attorney, Agent, or Firm*—Workman, Nydegger & Jensen

[57] ABSTRACT

An end stile apparatus and method for an overhead door section. The end stile is formed from a rectangle of sheet metal folded longitudinally into a modified J configuration in cross section. Mounting elements in the form of tabs and clips are prepared from a side of the end stile and serve as part of the anchoring system for mounting a panel to the end stile.

6 Claims, 2 Drawing Figures

END STILE APPARATUS AND METHOD FOR AN OVERHEAD DOOR SECTION

BACKGROUND

1. Field of the Invention

This invention relates to an overhead door system and, more particularly, to an end stile apparatus and method for an overhead door section.

2. The Prior Art

Overhead doors are relatively common and are used for numerous applications with the most frequent in large commercial or residential entrances such as to a garage. The overhead door takes its name from the method by which it operates as a door. In particular, the door is mounted in a vertical track affixed on each side of the opening. The tracks curve upwardly into a horizontal position so that the door may be raised to the open position where it is supported in a horizontal, overhead position. The door is customarily fabricated from a plurality of sections hingedly joined along the longitudinal edges so that the overall door structure will generally conform to the radius of curvature of the track as it changes from the vertical position to the horizontal position. Customarily, each of the sections are fabricated separately and thereafter hinged together along the longitudinal edges at the construction site during assembly.

Each overhead door section is generally fabricated from a sheet metal stock which has been rolled or otherwise formed into a particular section facing having a web along each longitudinal edge, and parallel, interior flange configurations. Vertical stiles consisting of an end stile at each end of the overhead door section and one or more center stiles are mounted transversely to the sheet metal panel to provide the necessary truss characteristics to the panel. Hinges are mounted directly to the stiles so that the forces imposed by the raising and lowering of the door are transmitted directly through the vertical stiles. A more detailed description of an overhead door and overhead door section and method are disclosed in our related patent, U.S. Pat. No. 4,284,119 issued Aug. 18, 1981.

Each of the foregoing patents describe a novel overhead door section and overhead door system and method whereby a high tensil steel is formed into the overhead door section panel and mounted to a novel end and center stile system. Each of the end stiles as described in these patents requires a separate angle brace for mounting the overhead door panel to the end stiles. This, therefore, requires a separate manufacturing step to produce the angle brace as well as additional assembly steps to assembly the apparatus into an overhead door section.

In view of the foregoing, it would be an advancement in the art to provide an end stile for an overhead door section whereby integral tabs are provided for mounting the panel to the end stile. It would also be an advancement in the art to provide an end stile for an overhead door section whereby the tabs are formed having different spacing from the front element of the end stile to accommodate a panel having a predetermined design formed therein. Such a novel end stile apparatus and method for an overhead door section is disclosed and claimed herein.

BRIEF SUMMARY AND OBJECTS OF THE INVENTION

The present invention relates to a novel end stile apparatus and method for an overhead door section wherein the end stile is fabricated from a sheet metal stock and is formed with a generally J configuration (in cross section). A plurality of tabs readily adapt the end stile to mounting of the panel. The tabs are formed with one or more predetermined spacing from the front element of the end stile and, depending upon the pattern formed in the panel, may be used to either clip or serve as a basal mounting element for mounting the panel to the end stile.

It is, therefore, a primary object of this invention to provide improvements in end stiles for an overhead door section.

Another object of this invention is to provide improvements in the method for securing an end stile to an overhead door section panel in order to form an overhead door section.

Another object of this invention is to provide an end stile having a plurality of tab devices formed therein for securing the end stile to the panel of an overhead door section.

These and other objects and features of the present invention will become more fully apparent from the following description and appended claims taken in conjunction with the accompanying drawing.

DETAILED DESCRIPTION OF THE PREFERRED EMBODIMENTS

Figure 1:
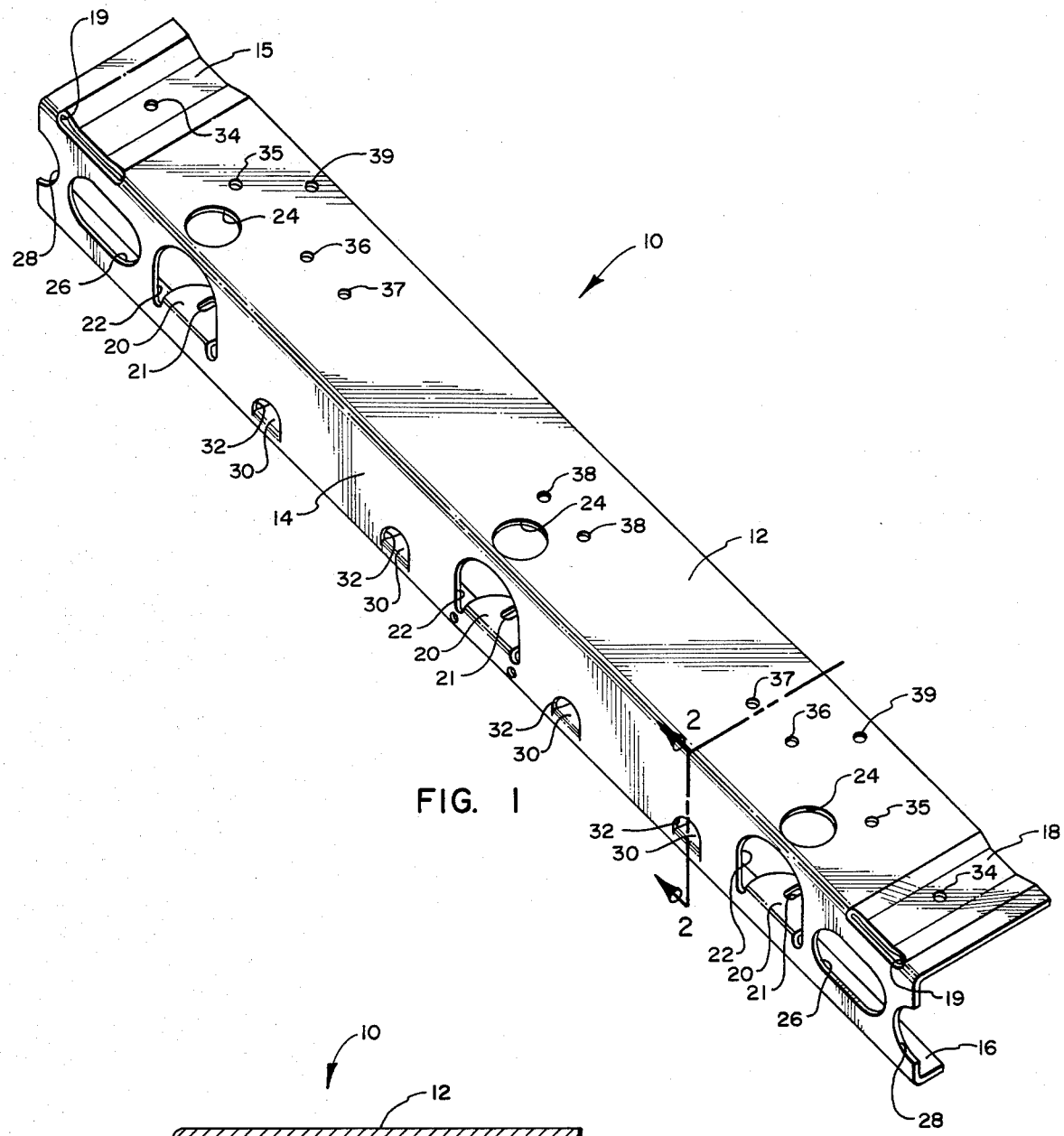
FIG. 1 is a perspective view of the back side of a presently preferred embodiment of the novel end stile of this invention.

The invention is best understood by reference to the drawing wherein like parts are designated with like numerals throughout.

Referring now more particularly to FIG. 1, a first preferred embodiment of the novel end stile of this invention is shown generally at 10 and is formed from a rectangle of sheet metal bent longitudinally into a modified J configuration (as viewed in cross section, depending upon which end view is taken). End stile 10 includes a back element 12, a side element 14 and a front element 16. Back element 12 is the primary load-bearing element and forms the leg of the J configuration. Side element 14 encloses the end of the overhead door section. Front element 16 is relatively narrow and serves as a protective strip for the end of the panel and an anvil against which the panel is clipped by clips 30 as will be discussed more fully hereinafter with respect to the description of FIG. 2.

End stile 10 is specifically configured to be attached to one end of an overhead door section panel and to cooperate in conjunction with one or more center stiles (not shown), hinges, and the like (not shown) to thereby form a complete overhead door section. End stile 10 is conventional in that it acts as a weight-bearing member for distribution of stresses longitudinally thereon thus providing the primary support for the overhead door section. The function of end stile 10 will be discussed more fully hereinafter following a thorough discussion of its various novel features.

A plurality of tabs 20 and clips 30 are formed in side element 14. Tab 20 is formed by a punch cutting an oversize opening 22 in side element 14 leaving tab 20. Tab 20 is bent inwardly at a right angle to side element 14 and parallel to back element 12 and front element 16. A slot 21 is punched through tab 20 and serves as a rivet-receiving hole.

Clips 30 are likewise formed from a segment of side element 14 by being punched therefrom and bent inwardly and forwardly toward front element 16 with a slight bow configuration best seen at bow 31 of FIG. 2 to thereby provide a desirable spring clip feature for clip 30, the function of which will be discussed more fully hereinafter.

Holes 24 are punched in back element 12 for the purpose of providing access to a rivet (rivet 46 of FIG. 2) as will be discussed more fully hereinafter. Access ports 26 are also provided in side element 14 for the purpose of permitting the operator (not shown) to have access to the interior of end stile 10 when the same is secured into an overhead door section (not shown). Further, notches 28 are prepared in side element 14 of end stile 10 for the purpose of receiving a groove portion formed in a trough of the panel structure (not shown) to accommodate the tongue and groove relationship between adjoining overhead door sections.

Lateral, hem-receiving grooves are provided at each end of back element 12 with a cut-out 19 facilitating formation of the hem-receiving grooves 18. Hem-receiving grooves 18 receive the edge hems of the panel when the end stile is attached to the end of the panel thereby providing a flush surface between back element 12 and the panel attached to end stile 10. Holes 34 and 35 serve as bolt-receiving holes for mounting a hinge (not shown) to back element 12. Advantageously, the hem (not shown) can be free floating on the overhead door section until the hinges (not shown) are suitably affixed to both holes 34 and 35 thereupon securely clamping the hem of the panel (not shown) in groove 18 and, correspondingly, to back element 12. A plurality of holes 36–39 are also provided in back element 12 for the purpose of bolting additional accessories to end stile 10.

Figure 2:
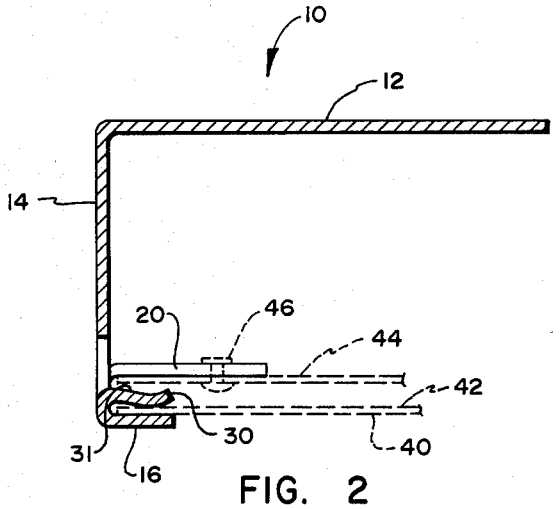
FIG. 2 is a cross-sectional view taken along lines 2—2 of FIG. 1.

Referring now more particularly to FIG. 2, the interrelationship between tabs 20 and clips 30 is more clearly set forth in the environment of a panel (shown in broken lines at 40) of an overhead door section. A rivet 46 is illustrated to shown the securement of panel 40 to end stile 10 and, more particularly, tab 20. In the illustrated embodiment, panel 40 is configurated with a front surface 42 and a decorative and structural ridge or groove 44 embossed therein. Panel 40 is configurated to be anchored at its front surface 42 between the spring clip action of clip 30 and front element 16 in clipping relationship. This not only permits rapid assembly but also securely holds panel 40 against front element 16 thereby substantially reducing vibration, rattling, and the like.

Tabs 20 are offset from front element 16 a predetermined spatial distance so as to receive thereagainst the back surface of a ridge, groove, decorative embossment, or the like formed in panel 40. Accordingly, one or more spatial separations can be selectively provided between tabs 20 and front element 16 to accommodate various preselected arrangements of grooves 44 that may be selectively formed in panel 40. In the illustrated embodiment, only one groove depth is shown by the interrelationship of tab 20 and groove 44. However, it is to be clearly understood that any suitable number of spatial interrelationships can be provided by the novel apparatus and method of this invention.

In operation, the operator (not shown) obtains an end stile 10 and orients end stile 10 relative to the panel 40. Each end of end stile 10 is a mirror image of the other end thereby readily accommodating an end-for-end reversal of end stile 10 to accommodate placement at either edge of the panel 40. The front surface 42 of panel 40 is clipped between clip 30 and front element 16 and thereafter rivets 46 are inserted through slots 21 to securely mount groove 44 and, correspondingly, panel 40 to end stile 10. The hems of the edge of panel 40 (not shown) are received in the hem-receiving grooves 18 and are essentially free floating until the various overhead door sections are hingedly joined together into an overhead door. It is clear, therefore, that the novel end stile apparatus and method of this invention facilitates the rapid, secure assembly of an overhead door section so that the overhead door section is sturdy and well supported against rattling by wind, or the like, while simultaneously protecting the edge of the panel by enclosing the same securely within the rigid sheet metal structure of end stile 10.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An end stile for an overhead door comprising:

A back element, the back element being relatively wide and having a length generally corresponding to a width of the overhead door section and a hem-receiving indentation at each end;

a side element having a length corresponding to the length of the back element and a width corresponding to the thickness of the overhead door section;

a front element having a length corresponding to the length of the back element and a relatively narrow width, the back element, side element and front element are formed from a single piece of sheet metal formed into a modified J-shaped cross section; and securement means for securing the end stile to an overhead door section panel comprising tab means formed in the end stile, said tab means comprising a spring clip means for clipping the panel to the front element, said tab means comprising a tab spaced from the front element, the tab serving as a securement element for the panel, said tab means comprising a first tab means and at least a second tab means, the first tab means spaced a first distance from the front element and the second tab means spaced a second distance from the front element.

2. The end stile defined in claim 1 wherein the tab means is formed from the side element.

3. The end stile defined in claim 1 wherein each end of the end stile is substantially identical so that the end stile can be used at either end of an overhead door section.

4. An end stile for an overhead door section comprising:

a piece of sheet metal folded into a modified J cross section having a relatively narrow front element, a side element and a relatively wide back element;

hem-receiving indentations at each end of the back element; and tab means formed from the side element for anchoring a panel to the end stile, said tab means comprising a first tab means and a second tab means, the first tab means spaced a first distance from the front element and the second tab means spaced a second distance from the front element.

5. The end stile defined in claim 4 wherein the first tab means comprises a spring clip means for clipping a panel of an overhead door section to the front element.

6. A method for mounting an end stile to a panel of an overhead door section comprising:

forming a piece of sheet metal into an end stile having a modified J-shaped cross section having a relatively narrow front element, a side element and a relatively wide back element;

preparing tab means in the end stile, the tab means serving as mounting means for mounting the end stile to the panel comprising forming the tab means in the side element with a first tab formed at a first distance from the front element for clipping the panel against the front element and a second tab spaced a second distance from the front element and serving as an anchor element for mounting the panel to the end stile; and mounting the end stile to the panel with the tab means.

* * * * *